US006470843B2

(12) United States Patent
Zechiel et al.

(10) Patent No.: US 6,470,843 B2
(45) Date of Patent: Oct. 29, 2002

(54) ROCKER ARM ADJUSTMENT SCREW ASSEMBLY

(75) Inventors: Scott Russell Zechiel, Canton, MI (US); Jon DePentu, Canton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 72 days.

(21) Appl. No.: 09/784,427

(22) Filed: Feb. 16, 2001

(65) Prior Publication Data

US 2002/0112686 A1 Aug. 22, 2002

(51) Int. Cl.[7] ..... F01L 1/18; F01L 1/20

(52) U.S. Cl. ..... 123/90.45; 123/90.35; 123/90.36; 123/90.39; 123/508

(58) Field of Search ..... 123/90.35, 90.36, 123/90.39–90.47, 507, 508; 74/519, 559

(56) References Cited

U.S. PATENT DOCUMENTS 4,815,424 A * 3/1989 Buuck et al. ..... 123/90.46
5,680,838 A * 10/1997 See et al. ..... 123/90.46
5,823,154 A * 10/1998 Kuhn et al. ..... 123/90.33
6,138,624 A * 10/2000 Torlai et al. ..... 123/90.39
6,148,780 A * 11/2000 O'Neill et al. ..... 123/90.46
6,199,526 B1 * 3/2001 Knickerbocker ..... 123/90.39
6,273,042 B1 * 8/2001 Perez et al. ..... 123/90.39

* cited by examiner

*Primary Examiner*—Weilun Lo
(74) *Attorney, Agent, or Firm*—Brooks & Kushman P.C.

(57) ABSTRACT

An adjustment screw assembly (10) having an adjustment screw (11) engaged to a rocker arm (14) of a combustion engine (12) is disclosed. The adjustment screw (11) comprises a lower member (26) and a vertical member (28) wherein the vertical member (28) threads to the rocker arm (14) and the lower member (26) secures pivotally and rotatably to the vertical member (28) forming a pivotal connection (31). The pivotal connection (31) has a male connector (38) which snap fits through an engagement lip portion (46) of a female socket (35) and is thereby held together for combustion engine assembly purposes. Once the adjustment screw (11) is assembled and placed within the combustion engine (12), internal springs (24) of the engine (12) resiliently hold and secure the lower member (26) to the vertical member (28).

16 Claims, 3 Drawing Sheets

ROCKER ARM ADJUSTMENT SCREW ASSEMBLY

TECHNICAL FIELD

This invention relates to an adjustment screw and more particularly to an adjustment screw assembly having rocker arms for a combustion engine.

BACKGROUND OF THE INVENTION

Adjustment screws are commonly utilized in combustion engine applications to provide a pivotal linkage and fine tune the interconnection between rocker arms, valves and fuel injector followers. For diesel engine applications, the adjustment screw is also utilized as the pivotal linkage between the rocker arm and a fuel injector follower. The adjustment screw must be adjustable to manage clearance, and therefore clatter, between the adjustment screw and valves or fuel injector follower. Furthermore, when the adjustment screw is used for fuel injector follower applications oil lubrication is required between the follower and the adjustment screw. This oil is supplied internally through the rocker arm.

The adjustment screw has a lower button and a vertical member. The vertical member engages adjustably to the rocker arm and the lower button engages pivotally to the vertical member. A resilient clip device is typically used to connect the lower button to the vertical member. The clip assures that the lower button does not fall away from the vertical member during assembly of the combustion engine. After assembly, the clip serves no further function because a spring of the combustion engine provides an upward force which holds the lower button against the end of the vertical member. In addition, clearances are such that it does not allow the button to come out. Although the clip is required only during assembly, the clip is not readily removable from the adjustment screw and therefore remains installed throughout the useful life of the combustion engine. Unfortunately, the clip is a latent concern, with a possibility to fragment during prolonged operation of the combustion engine. Any fragments have a possibility to become lodged within the engine block or entrained within the lubricating oil, thereby creating an engine operation and warranty concern.

SUMMARY OF THE INVENTION

The invention provides an adjustment screw assembly having a pivoting rocker arm for a combustion engine. The adjustment screw has a vertical member having an upper end threaded adjustably to the rocker arm and a lower end. An upper end of a lower member is pivotally connected to the lower end of the vertical member forming a pivotal connection. The pivoting action of the rocker arm causes the adjustment screw to oscillate which in turn causes a linear up and down movement of an actuator through contact of a bottom surface of the lower member to a top surface of the actuator. Because the contact is continuous and the bottom surface remains parallel to the top surface, the bottom surface slides back and forth transversely across the actuator's top surface as the actuator moves up and down. Preferably, the actuator is either valves or a fuel injector follower for a diesel engine.

The pivotal connection comprises a male connector snap fitted inside a female socket. The female socket has an engagement lip portion having an inner edge centering about a female socket centerline. The male connector has an outer perimeter centering about a male connector centerline. A male connector diameter of the outer perimeter is slightly larger than an inner edge diameter, thereby forming the snap fit as the outer perimeter of the male connector is forced past the inner edge of the female socket. Preferably, to accomplish the snap fit, the female socket centerline is offset to the male connector centerline at a prescribed angle during the snapping action. The female socket may either be the upper end of the lower member or the lower end of the vertical member, and vice-versa for the male connector.

By use of this snap fit lower member, it is possible to eliminate the clip once used to secure the lower member to the vertical member thereby rendering a reduction of parts used to construct the adjustment screw.

BRIEF DESCRIPTION OF THE DRAWINGS

Reference is now made to the accompanying drawings, in which.

DETAILED DESCRIPTION OF THE PREFERRED EMBODIMENTS

Figure 1:
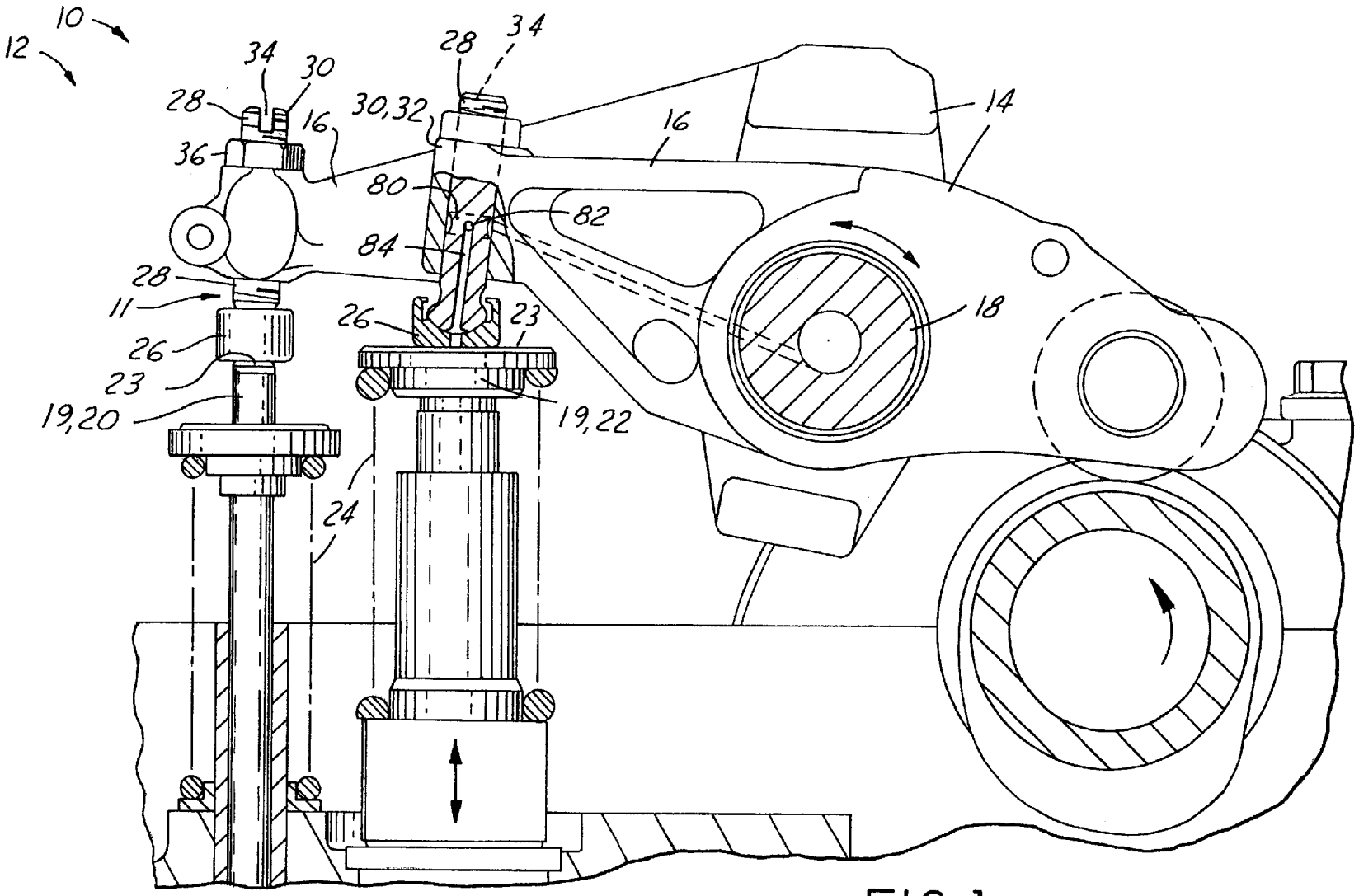
FIG. 1 is a cross-sectional view of two adjustment screws viewed within a rocker-arm assembly environment in accordance with the invention.

Referring now to FIG. 1 of the drawings, two adjustment screw assemblies 10 are shown within a combustion engine environment, preferably a diesel engine 12. Each adjustment screw assembly 10 has an adjustment screw 11 engaging a pivoting rocker arm 14 at a radially extended rocker arm end 16. Although movement of the rocker arm 14 is pivotal about a shaft 18, movement at the extended rocker arm end 16 is substantially vertical, with some rotational pivoting movement present. Each rocker arm 14 connects perpendicular to a common shaft 18. Disposed beneath each adjustment screw 11 is an actuator 19 which can either be a valve or a fuel injector follower 22. The longitudinal axes of the adjustment screw 11 and the actuator 19 are substantially co-linear and vertical. The adjustment screw 11 is generally perpendicular to the rocker arm 14. The actuator 19 is biased upward against the adjustment screw 11 at all times by installed springs 24. Springs 24 are therefore compressed at all times and positioned concentrically about the actuator 19.

Figure 2:
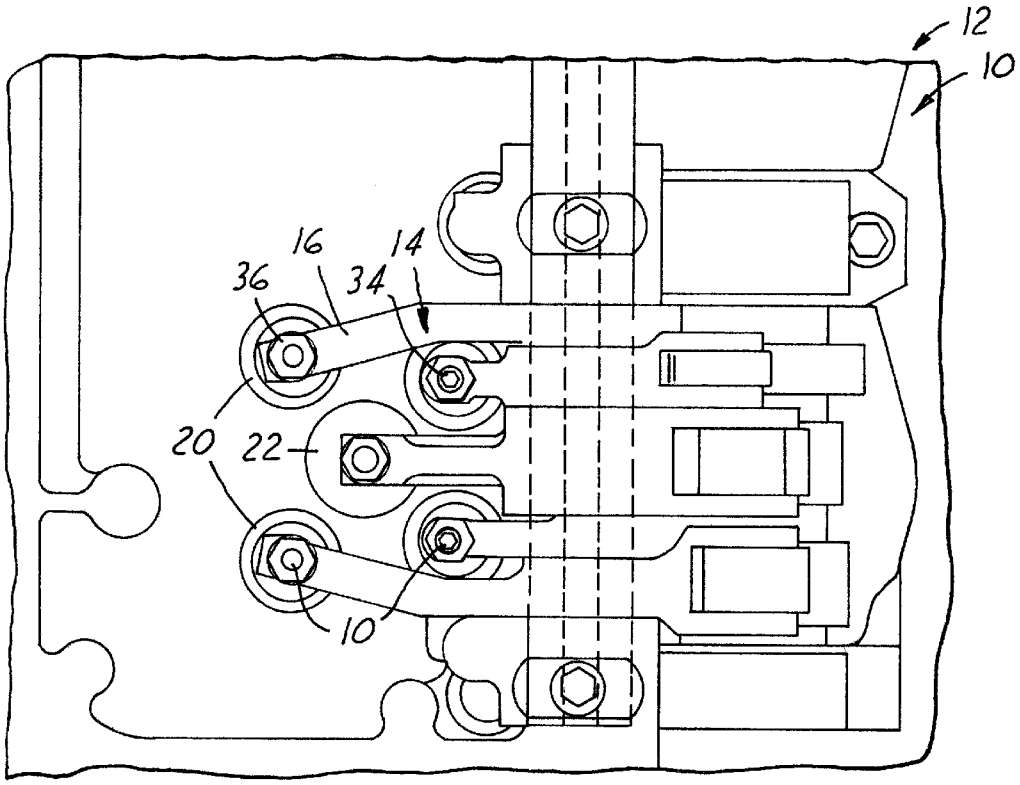
FIG. 2 is a partial perspective view of a combustion engine viewing downward with a rocker arm cover removed in order to view internal detail.

Referring to FIGS. 1 and 2, the adjustment screw 11 has a lower member 26 and a vertical member 28. The lower member 26 attaches pivotally to a lower end 29 of the vertical member 28. Lower member 26 has a bottom surface 48 in continuous contact with a top surface 23 of the actuator 19. The top surface 23 substantially moves in an up and down linear direction while the bottom surface 48 of the lower member 26 moves accordingly in the vertical direction. Because of the oscillating or pivoting action of the rocker arm end 16, the lower member 26 moves slightly in the transverse direction to the vertical movement of the actuator 19. This transverse movement causes the bottom surface 48 of the lower member 26 to slightly slide across the lubricated top surface 23 of the actuator 19.

Figure 3:
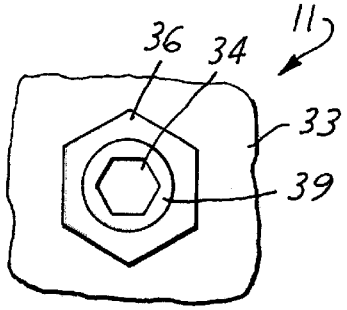
FIG. 3 is a plan view of the adjustment screw.

The vertical member 28 threadably connects within the rocker arm end 16. An upper end 27 of the vertical member 28 has outer diameter threads 30 engaging inner diameter threads 32 of the rocker arm 14. The height of adjustment screw 11 is adjustable via rotation between threads 30, 32 through a hexagonal shaped recess 34 exposed concentrically at the upper end 27 which protrudes through the rocker arm 14, also shown in FIG. 3. Adjustment is required to assure continuous contact between the top surface 23 of the actuator 19 and the bottom surface 48 of the lower member 26. Once adjusted, a locking nut 36 screws downward over threads 30, until the locking nut 36 tightens against a top surface 33 of the rocker arm end 16.

Referring to FIG. 2, each cylinder of the combustion engine, typically utilizes five adjustment screws 11. Four are applied to the exhaust and air intake valves 20 and one to the fuel injector follower 22. When the adjustment screw 11 is utilized for the fuel injector follower 22, additional oil lubrication is required between the lower member 26 and the fuel injector follower 22 as a form of cooling and lubrication. The rocker arm shaft 18 is hollow and thereby supplies oil through internal ports of the rocker arm 14 to the adjustment screw 11.

Figure 4:
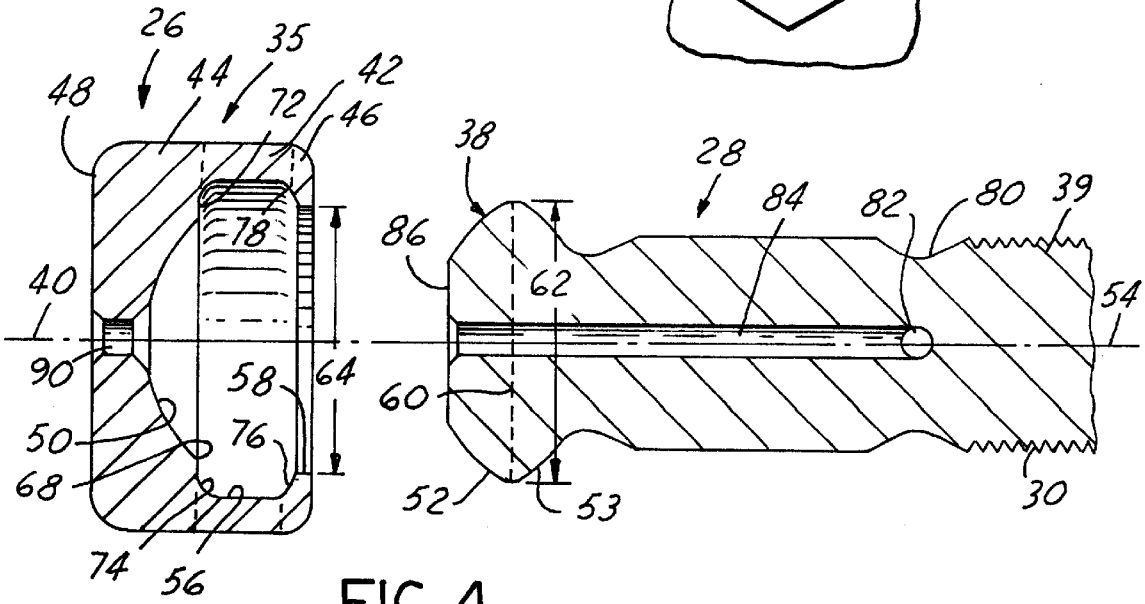
FIG. 4 is an exploded cross-sectional view of the adjustment screw.
Figure 8:
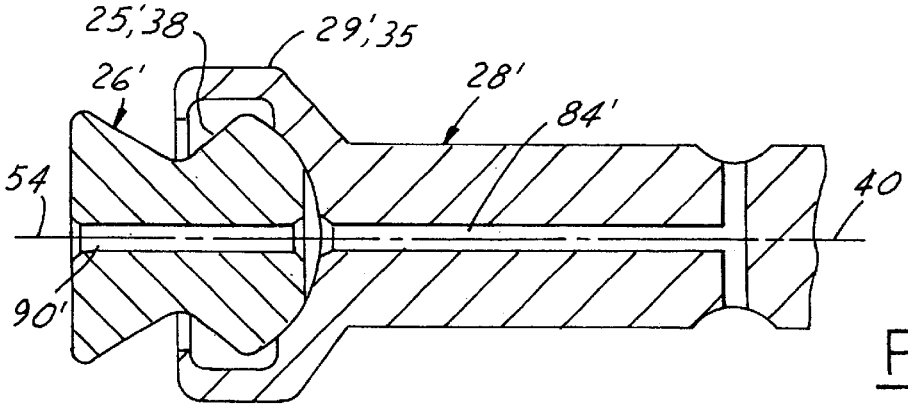
FIG. 8 is a cross-sectional view of a second embodiment of the adjustment screw.

Referring to FIG. 4, the lower member 26 has an upper end 25 which snap fits to the lower end 29 of the vertical member 28, thereby providing a rotational and pivotal connection 31. The upper end 25 and the mating lower end 29 take the form of a female socket 35 and a male connector 38. As shown, the upper end 25 is the female socket 35 and the lower end 29 is the male connector 38. However, this relationship can be reversed as shown in FIG. 8 as a second embodiment. The female socket 35 houses the male connector 38 having a male connector centerline 54. Centering about the male connector centerline 54 is a leading surface 52 which curves and substantially conforms to a hemisphere, expanding radially in the trailing axial direction (away from the pivotal connection).

The female socket 35 has a mid portion 42 connecting rigidly between a trailing portion 44 and an engagement lip portion 46. The mid, trailing, and engagement lip portions are each disposed about a female socket centerline 40. Centering about the female socket centerline 40 is a leading surface 50 of the trailing portion 44. Leading surface 50 is concave and semi-spherical in shape to pivotally and rotationally mate with the leading surface 52 of the male connector 38. The leading surface 50 conforms to the leading surface 52 forming the rotateable pivotal connection 31.

Figure 5:
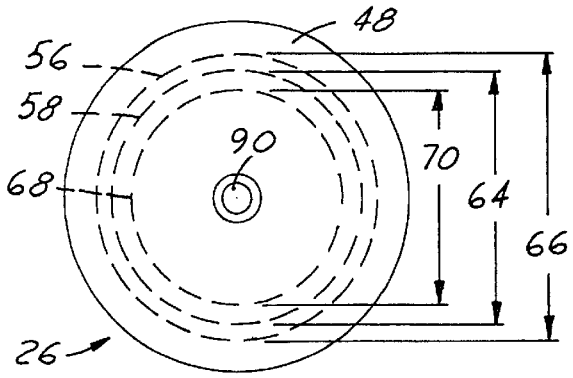
FIG. 5 is a perspective view of a leading surface of a lower member of the adjustment screw.

Referring to FIGS. 4 and 5, the mid portion 42 has an inner wall 56, and the engagement lip portion 46 has an inner edge 58, both centering about the female socket centerline 40. The leading surface 52 of the male connector 38 has an outer perimeter 60 having a male connector diameter 62 which is larger than an edge diameter 64 of the inner edge 58 yet smaller than a wall diameter 66 of the inner wall 56. The difference in length between the male connector diameter 62 and the edge diameter 64 is substantially small so that the male connector 38 can snap into the female socket 35 without causing permanent deformation, yet large enough so that the female socket 35 does not easily separate from the male connector 38. In assembly, the outer perimeter 60 aligns radially inward of the inner wall 56.

Sharing outer perimeter 60 with the leading surface 52 is a trailing surface 53. Trailing surface 53 centers about the male connector centerline 54 and generally tapers radially inward from the outer perimeter 60 in the trailing axial direction. In assembly, the engagement lip portion 46 of the female socket 35 is axially aligned to and disposed radially outward from the trailing surface 53.

The leading surface 50 of trailing portion 44 of female socket 35 has a perimeter 68 having a perimeter diameter 70 which is smaller than the outer perimeter 60 of the male connector 38. In other words, the leading surface 50 is generally smaller than the leading surface 52 of male connector 38. Regardless of the adjustment screw 11 pivoting action, or misalignment of the female socket centerline 40 to the male connector centerline 54, the outer perimeter 60 is always disposed radially outward of the perimeter 68 of leading surface 50. This will prevent binding between leading surface 50 and the leading surface 52.

The perimeter 68 of leading surface 50 and the inner wall 56 of mid portion 42 respectively define the inner and outer perimeters of a leading annular surface 72 of the trailing portion 44. Leading annular surface 72 extends radially, centers about female socket centerline 40, and is substantially perpendicular to the inner wall 56. A lower comer 74 formed by leading annular surface 72 and inner wall 56 is slightly curved. In axial opposition to the leading annular surface 72 of trailing portion 44 is a trailing annular surface 76 of the engagement lip portion 46. Likewise, the trailing annular surface 76 extends radially between the inner edge 58 and the inner wall 56, centers about female socket centerline 40 and is substantially perpendicular to the inner wall. The inner wall 56 and the trailing annular surface 76 form a slightly curved upper comer 78. The outer perimeter 60 of male connector 38 is disposed axially between the leading annular surface 72 of trailing portion 44 and the trailing annular surface 76 of the engagement lip portion 46.

As stated previously, the interface between the fuel injector follower 22 and the adjustment screw 11 must have additional lubrication. Additional lubrication flows through the shaft 18 which is hollow and through the rocker arm 14 as shown in FIG. 1. From the rocker arm 14, the oil flows into a circumferential groove 80 extending around the vertical member 28 of the adjustment screw 11. From the circumferential groove 80, the oil flows into a communicating radial port 82. Communicating generally with the longitudinal center of the radial port 82 is an axial port 84. Axial port 84 is concentric to and extends longitudinally along the vertical member centerline 54 from the radial port 82 through the lower end 29 of the vertical member 28.

Figure 6:
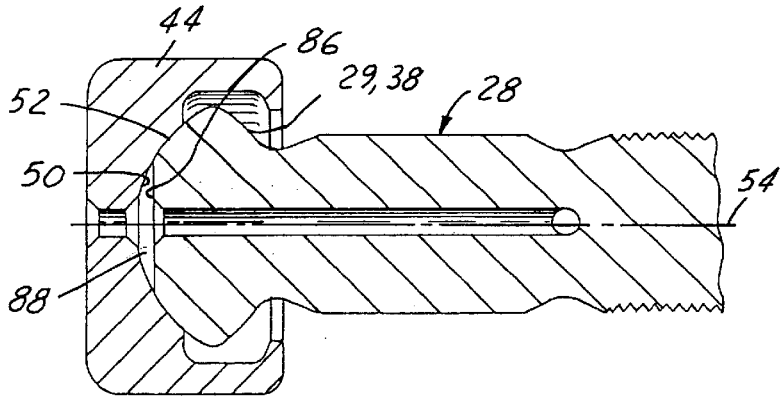
FIG. 6 is a cross-sectional view of the adjustment screw.

Referring to FIG. 6, the oil flows from the lower end 29 of vertical member 28 into a cavity 88. The cavity is defined between a radially extending and flat surface 86 of the leading surface 52 of the male connector 38 and the leading surface 50 of the trailing portion 44. Flat surface 86 centers about the male connector centerline 54.

Substantially concentric to and extending axially through the lower member 26 is an aperture 90. Aperture 90 communicates with cavity 88 and the top surface 23 of the fuel injector follower 22. Oil thereby flows from the axial port 84 into the cavity 88 and through the aperture 90 to provide lubrication at the fuel injector follower 22 interface. The cavity 88 assures communication and oil passage between the aperture 90 and the axial port 84 when the adjustment screw 11 is pivoting between the lower member 26 and the vertical member 28, respectively.

Figure 7:
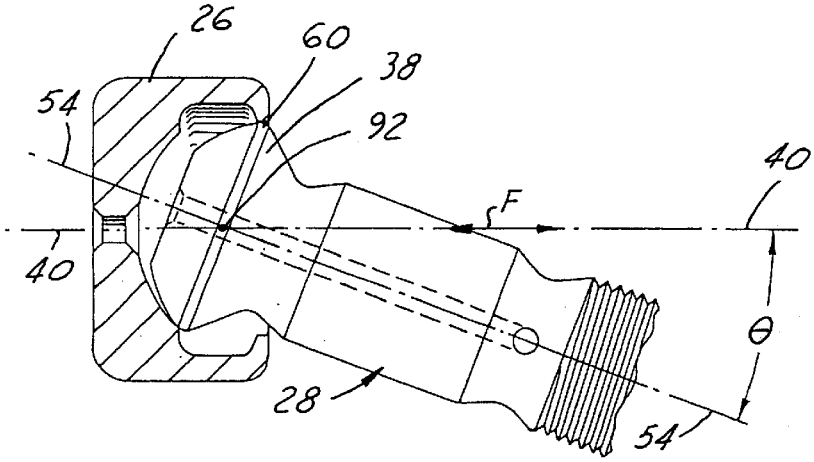
FIG. 7 is a cross-sectional view of the adjustment screw wherein a lower member centerline is offset from a vertical member centerline by a prescribed angle for assembly purposes.

Referring to FIG. 7, assembly of lower member 26 to the vertical member 28 is a snap fit. Snap fitting requires orientation of the male connector centerline 54 at a prescribed angle θ to the female socket centerline 40. An intersection 92 located along the male connector centerline 54 and aligned axially to the outer perimeter 60 is first aligned to the female socket centerline 40. The male connector centerline 54 is then offset to the prescribed angle θ from the female socket centerline 40 While maintaining the prescribed angle θ, the intersection 92 is moved along the female socket centerline 40 toward the female socket 35 until the male connector 38 snap fits into the female socket 35. The pivotal connection 31 is thereby formed and lower member 26 is pivotally and rotationally engaged to vertical member 28.

Preferably, the male connector diameter 62 is generally "12.65 millimeters, " the edge diameter 64 is generally "12.56 millimeters, " and the prescribed angle θ is approximately twenty degrees. The maximum installation load required to snap fit the female socket 35 to the male connector 38 must not exceed one hundred and thirty pounds at the twenty-degree prescribed angle θ. The minimum pull apart load shall not be lower than fifty pounds also at the twenty-degree prescribed angle θ. The load direction measures along the female socket centerline 40. The material of lower member 26 and vertical member 28 is steel, and the lower member 26 is heat treated.

Referring to FIGS. 1–7, the first embodiment of the invention is shown where the upper end 25 of the lower member 26 is the female socket 35. The aperture 90 centers about the female socket centerline 40. And, the lower end 29 of the vertical member 28 is the male connector 38. The axial port 84 centers about the male connector centerline 54.

Referring to FIG. 8, a second embodiment of an adjustment screw 11' is shown where the upper end 25' of the lower member 26' is the male connector 38. The aperture 90' centers about the male connector centerline 54. The lower end 29' of the vertical member 28' is the female socket 35. The axial port 84' centers about the female socket centerline 40.

Although the preferred embodiments of the present invention have been disclosed, various changes and modifications may be made thereto by one skilled in the art without departing from the scope and spirit of the invention as set forth in the appended claims

What is claimed is:

1. An adjustment screw assembly for a combustion engine comprising:

a rocker arm having a rocker arm end;

a shaft, the rocker art pivoting about the shaft, the rocker arm end disposed radially outward from the shaft, a vertical member having an upper end and a lower end, the upper end connected adjustably to the rocker arm end of the rocker arm, a radial port and an axial port, the radial port extended transversely through the vertical member, the radial port receiving oil from the rocker arm, the axial port concentric to the vertical member and extended longitudinally from the radial port through the lower end, the axial port receiving oil from the radial port, and a circumferential groove, the circumferential groove aligned axially and in communication with the radial port ends, the circumferential groove receiving oil from the rocker arm, the radial port receiving oil from the circumferential groove; and a lower member disposed below the vertical member, the lower member having an upper end and a bottom surface, the upper end snap fitted and thereby connected pivotally and rotationally to the lower end of the vertical member forming a pivotal connection, whereby a top surface of an actuator is in continuous planar contact with the bottom surface of the lower member while the rocker arm causes the vertical member to oscillate and the actuator to move linearly up and down, the bottom surface sliding back and forth transversely across the top surface as the actuator moves up and down.

2. An adjustment screw assembly as set forth in claim 1 wherein the pivotal connection comprises:

a male connector having:

an outer perimeter centered about a male connector centerline, the outer perimeter having a male connector diameter perpendicular to the male connector centerline, and trailing surface disposed radially outward and tapering radially inward from the outer perimeter in the axial trailing direction, the trailing surface centered about the male connector centerline; and a female socket engaged pivotally and rotationally to the male connector, the female socket having:

an engagement lip portion, the engagement lip portion having an inner edge centered about a female socket centerline, the inner edge extending laterally and axially through the engagement lip portion, the inner edge aligned axially to and disposed radially outward of the trailing surface, the inner edge having an edge diameter smaller than the male connector diameter.

3. An adjustment screw assembly as set forth in claim 2 wherein the pivotal connection further comprises:

the female socket having a trailing portion and a mid portion, the trailing portion axially trailing and connected to the mid portion, the mid portion axially trailing and connected to the engagement lip portion, the trailing portion having a leading surface centered about the female socket centerline, the mid portion having an inner wall extended axially through the mid portion, the inner wall centered about the female socket centerline; and the male connector having a leading surface engaged pivotally and rotationally to the leading surface of the female socket, the leading surface of the male connector defined by the outer perimeter, the outer perimeter aligned axially to and disposed radially inward from the inner wall of the mid portion.

4. An adjustment screw assembly as set forth in claim 3 wherein the leading surface of the female socket is concave and curved to mate with the leading surface of the male connector which is convex and semi-hemispherical.

5. An adjustment screw assembly as set forth in claim 4 wherein the trailing portion has a leading annular surface disposed about the leading surface, the leading annular surface perpendicular to the female socket centerline, the leading annular surface defined radially inward by a perimeter of the leading surface and radially outward by the inner wall of the mid portion, the perimeter having a perimeter diameter less than the edge diameter.

6. An adjustment screw assembly as set forth in claim 5 wherein the actuator is a valve and fuel injector followers.

7. An adjustment screw assembly as set forth in claim 5 wherein the actuator is a fuel injector follower.

8. An adjustment screw assembly as set forth in claim 1 wherein the pivotal connection further comprises a cavity, the cavity defined by the leading surface of the trailing portion and a flat surface of the leading surface of the male connector, the flat surface radially inward and concentric to the leading surface of the male connector, the axial port providing oil to the cavity.

9. An adjustment screw assembly as set forth in claim 8 wherein the lower member has an aperture, the aperture extended longitudinally through the lower member, the aperture in communication with the top surface and the cavity, the cavity providing oil to the aperture, the aperture providing oil to the top surface of the fuel injector follower.

10. An adjustment screw assembly as set forth in claim 9 wherein the upper end of the lower member is the female socket and the lower end of the vertical member is the male connector.

11. An adjustment screw assembly as set forth in claim 9 wherein the upper end of the lower member is the male connector and the lower end of the vertical member is the female socket.

12. An adjustment screw assembly as set forth in claim 9 wherein the lower member and vertical member are steel.

13. An adjustment screw as set forth in claim 12 wherein the steel lower member is hardened.

14. An adjustment screw for a rocker arm of a combustion engine comprising:

a vertical member having an upper end and a lower end, me upper end connected adjustably to the rocker arm, the vertical member oscillating in relation to the pivoting rocker arm, the vertical member having a radial port, an axial port and a circumferential groove, the radial port extended transversely through the vertical member, the axial port concentric to the vertical member and extended longitudinally from the radial member trough the lower end, the circumferential groove aligned axially and in communication with the radial port ends, the circumferential groove receiving oil from the rocker arm, the radial port receiving oil from the circumferential groove, the axial port receiving oil from the radial port;

a lower member disposed below the vertical member, the lower member having an upper end and a bottom surface, the upper end snap fitted and thereby connected pivotally and rotationally to the lower end of the vertical member, the bottom surface in continuous planar contact with a top surface of an actuator, the top surface movement being linear, and an aperture extended longitudinally through the lower member; and a pivotal connection formed by the snap fitted connection of the upper end of the lower member and the lower end of the vertical member, the pivotal connection having:

a female socket engaged pivotally and rotationally to the male connector, the female socket having a female socket centerline, a trailing portion, a mid portion, and an engagement lip portion, the trailing portion axially trailing and connected to the mid portion, the mid portion axially trailing and connected to the engagement lip portion, the trailing portion having a leading surface and a leading annular surface, the leading surface centered about the female socket centerline, the leading annular surface disposed about and concentric to the leading surface, the mid portion having an inner wall extended axially through the mid portion and centered about the female socket centerline, the leading annular surface defined radially inward by a perimeter of the leading surface and radially outward by the inner wall of the mid portion, the engagement lip portion having an inner edge extended laterally and axially through the engagement lip portion and centered about the female socket centerline, the perimeter having a perimeter diameter less than an edge diameter of the inner edge, a male connector having a male connector centerline, a leading surface, an outer perimeter, and a trailing surface, the leading surface being convex and semi-hemispherical to mate pivotally and rotationally to the concave and curved leading surface of the female socket, the leading surface of the male connector defined by the outer perimeter, the outer perimeter centered about the mate connector defined by the outer perimeter, the outer perimeter centered about the male connector centerline and aligned axially to and disposed radially inward from the inner wall of the mid portion, the outer perimeter having a male connector diameter perpendicular to the male connector centerline, the male connector diameter greater than the edge diameter of the inner edge of the engagement lip portion, the trailing surface disposed radially outward and tapered radially inward from the outer perimeter in the axial trailing direction, tie trailing surface centered about the male connector centerline, the inner edge of the engagement lip aligned axially to and disposed radially outward of the trailing surface, and a cavity defined by the leading surface of the trailing portion of the female socket and a flat surface of the leading surface of the male connector, the flat surface radially inward and concentric to the leading surface of the male connector, the axial port providing oil to the cavity, wherein the aperture in the lower member is in communication with the top surface of the actuator and the cavity, the cavity providing oil to the aperture, the aperture providing oil to the top surface of the actuator.

15. An adjustment screw as set forth in claim 14 wherein the upper end of the lower member is the female socket and the lower end of the vertical member is the male connector.

16. An adjustment screw as set forth in claim 14 wherein the upper end of the lower member is the male connector and the lower end of the vertical member is the female socket.

* * * * *

UNITED STATES PATENT AND TRADEMARK OFFICE

CERTIFICATE OF CORRECTION

PATENT NO. : 6,470,843 B2
DATED : October 29, 2002
INVENTOR(S) : Scott Russell Zechiel and Jon DePentu It is certified that error appears in the above-identified patent and that said Letters Patent is hereby corrected as shown below:

Column 7,
Line 27, delete “me” and insert -- the --.
Line 34, delete “trough” and insert -- through --.

Column 8,
Line 36, delete “tie” and insert -- the --.

Signed and Sealed this

Eighth Day of April, 2003

JAMES E. ROGAN
*Director of the United States Patent and Trademark Office*